US006247194B1

(12) United States Patent
Desjoyaux et al.

(10) Patent No.: US 6,247,194 B1
(45) Date of Patent: Jun. 19, 2001

(54) FILTERING STAIRWAY FOR SWIMMING POOL

(75) Inventors: Jean Louis Desjoyaux, L'Etrat; Pierre Louis Desjoyaux, La Fouillouse; Catherine Jandros, L'Etrat, all of (FR)

(73) Assignee: Piscines Desjoyaux S.A., Lafouillouse (FR)

( * ) Notice: Subject to any disclaimer, the term of this patent is extended or adjusted under 35 U.S.C. 154(b) by 0 days.

(21) Appl. No.: 09/171,062

(22) PCT Filed: Apr. 9, 1997

(86) PCT No.: PCT/FR97/00632

§ 371 Date: Oct. 9, 1998

§ 102(e) Date: Oct. 9, 1998

(87) PCT Pub. No.: WO97/39211

PCT Pub. Date: Oct. 23, 1997

(51) Int. Cl.[7] ..... E04H 4/00
(52) U.S. Cl. ..... 4/506
(58) Field of Search ..... 4/489, 494, 506–509

(56) References Cited

U.S. PATENT DOCUMENTS 3,755,981 9/1973 West .
5,056,167 * 10/1991 Cholley ..... 4/494 X

FOREIGN PATENT DOCUMENTS 0145619 5/1985 (EP) .
0279140 8/1988 (EP) .
0599666 6/1994 (EP) .

OTHER PUBLICATIONS

Database WPI; Week 12 Apr. 984, Derwent Publications, Ltd., London, G AN 84–134030 & AU–D–8916182D.

* cited by examiner

*Primary Examiner*—Charles E. Phillips
(74) *Attorney, Agent, or Firm*—Wall Marjama & Bilinski

(57) ABSTRACT

A stairway for a swimming pool fabricated by a rotational molding technique having a set of stairs in its front face and a hollow reservoir therein that communicates with the pool. A separate box also formed by a rotational molding technique is attached to the back of the stairway and contains a pump. A filtering system is contained inside the stairway and is attached to the pump to circulate pool water therethrough.

14 Claims, 10 Drawing Sheets

FILTERING STAIRWAY FOR SWIMMING POOL

BACKGROUND OF THE INVENTION

The invention relates to the technical field of water filtration for swimming pools.

To date, numerous technical solutions are known which allow the water of a swimming pool to be filtered. Filtration is obtained by means of one or more filters mounted in combination with a circuit for drawing in and delivering water.

It has, for example, been proposed that the pumping or filtration means be incorporated into a compact block mounted in combination with the panels of which the pool of the swimming pool is made. One of the parts of the block is submerged in the water and houses the filtration means, while another part is situated out of the pool and has the means for drawing in and delivering the water, which means are mounted in combination with the said filtration means.

This solution emerges, for example, from the teaching of patent EP-A-0,145,619. The part submerged in the water may have arrangements acting as the treads of steps.

However, for reasons of convenience, the consumer often wants the swimming pool to be equipped with a conventional set of steps and, more generally, with steps of a rounded shape, very often located at the end of the swimming pool. These steps, given their shape, are known by the name of Roman steps.

It has also been proposed that filtering Roman steps be produced, these being based on the same principle as the one defined in the aforementioned patent EP-A-0,145,619. The part submerged in the water has a rounded overall shape, incorporating the treads of the steps and housing the filtration system. This part submerged in the water is connected to the part out of the ground, which houses the intake and delivery means. The part submerged in the water is not incorporated into the panels of the swimming pool, but is superimposed on these, which latter panels have to be shaped to delimit a rounded surface corresponding to that of the steps.

After the two parts of the steps have been attached to the swimming pool panels there remains, between the rear face of the steps and the front face of the profiled panels, an empty space which later will be filled with water. This means that leaves or other undesirables may accumulate in this space, and this may cause significant problems as far as overall pool maintenance is concerned.

Mention may also be made of the teaching of patent EP-A-0,279,140 which relates to a module made of a prefabricated assembly made of reinforced resin of the polyester kind, and which comprises a set of steps of several treads which adjoin a technical tank and a filtration tank. The technique used for manufacturing this module is not, however, rational. Watertightness problems may arise.

SUMMARY OF THE INVENTION

The set objective of the invention is to overcome these drawbacks in a simple, reliable, effective and rational way.

The problem that the invention sets out to solve is that of producing a filtering set of steps shaped to be mounted directly with adjacent panels forming the pool of the swimming pool, and overcoming the problem of watertightness, the objective at the same time being that of producing steps, the cost of which is particularly low, and which can be installed quickly and easily, while at the same time retaining very high filtration efficiency with the possibility of adding additional functions thereto.

the body of the steps delimits a hollow closed volume obtained by rotational moulding in order to constitute a reservoir, the front face of which has treads, the reservoir is in communication with the water in the pool, the reservoir has internal arrangements to allow the fitting of a filtration system in communication with the water contained in the said reservoir, the face of the body, which is the opposite face to the one which has the treads, has arrangements for fitting and attaching a box obtained by rotational moulding, and in which are fitted the intake and delivery means in combination with the filtration system, and the body laterally has arrangements for the attaching of the adjacent panels which make up the pool part of the swimming pool.

It is therefore clear that the filtering steps assembly is produced by rotational moulding, a technique which is perfectly well known to those skilled in the art, but which has never been used for producing filtering steps. This rotational moulding technique proves to be particularly beneficial to the application envisaged, given that there is obtained, directly, at the time of manufacture, a reservoir which is perfectly watertight, and in which the filtration means can be mounted in combination with specific arrangements.

In order to solve the set problem of being easily able to equip the body of the steps which serves as reservoir for the filtration system, the internal arrangements for mounting the filtration system consist of ribs formed in the bottom of the reservoir directly from rotational molding, the said ribs, one of the ends of the pipe opening from the plate to be connected to the base of at least one support carrying a filter bag, the other end of the said pipe opening in the region of the arrangement for connecting the reservoir to the box containing the pumping means.

In order to solve the set problem of mounting the entire filtration system inside the reservoir of the body of the steps, the upper part of the support carrying the filter bag or bags is connected in a watertight manner into a mounting plate itself secured in a watertight fashion to a chimney formed near the top of the reservoir in communication with an access hatch closed by a removable cover.

In order to solve the set problem of allowing water to be drawn in and delivered in combination with the filtration system, the pipe mounted in the plate and connected to the filtration system, is connected to the intake connection of the pump, the delivery connection of which is connected to a pipe opening into one of the treads of the steps of the reservoir.

In order to solve the set problem of providing attachment to the reservoir, the arrangements for fitting and attaching the box containing the intake and delivery pump consist, on the one hand, of braces formed during the rotational moulding of the reservoir and on which the said box rests and, on the other hand, of a centring preform interacting with an opening formed in the box, the said preform, which constitutes a hollow body, containing the intake and delivery pipes.

Another problem that the inventions sets out to solve, is that of being able to incorporate other functions into the filtering steps.

To this end, one of the treads has, at its horizontal face, directly from rotational molding, ribs delimiting hollow spaces so that they communicate with an air intake connected by a pipe to a component located in the technical box, the said tread having a microperforated plate.

In order to solve the set problem of being able to attach the steps assembly in continuity with the panels that form the pool part of the swimming pool, the arrangements for attaching the adjacent panels consist of lateral flanges within the thickness of which metal inserts capable of accommodating fasteners are embedded.

In order to solve the set problem of mounting the steps, in combination with the liner with which the inside of the pool of the swimming pool is generally equipped, the front face of the reservoir, in the region of the treads, has a U-shaped clamp containing a screwing support covered by a gasket for attaching a liner cut to a U-shape, and attached to the support by means of screws covered with a protective strip.

According to another feature, one of the risers incorporates, from the rotational moulding operation, arrangements for positioning at least one lamp.

BRIEF DESCRIPTION OF THE DRAWINGS

The invention is explained hereafter in greater detail with the aid of the appended drawings, in which.

DETAILED DESCRIPTION OF THE INVENTION

As shown in the FIGS. 1–6, of the drawings, the the body (1) of the filtering steps delimits a hollow closed volume obtained by rotational molding to form a reservoir. The front face of the reservoir has treads (1*b*) . More specifically, the body (1) has, when seen in plan view, a semicircular overall shape (FIG. 3) and, when viewed transversely (FIG. 5), a profile incorporating a number of right angles. Furthermore, the body (1) of the steps has, directly from rotational moulding, a housing (1*c*) for incorporating a filtration system, which will be discussed at greater length later in the description.

In order to increase the rigidity of the body (1), the the body has a number of horizontal (1*d*) and vertical (1*e*) ribs made by rotational moulding.

Figure 3:
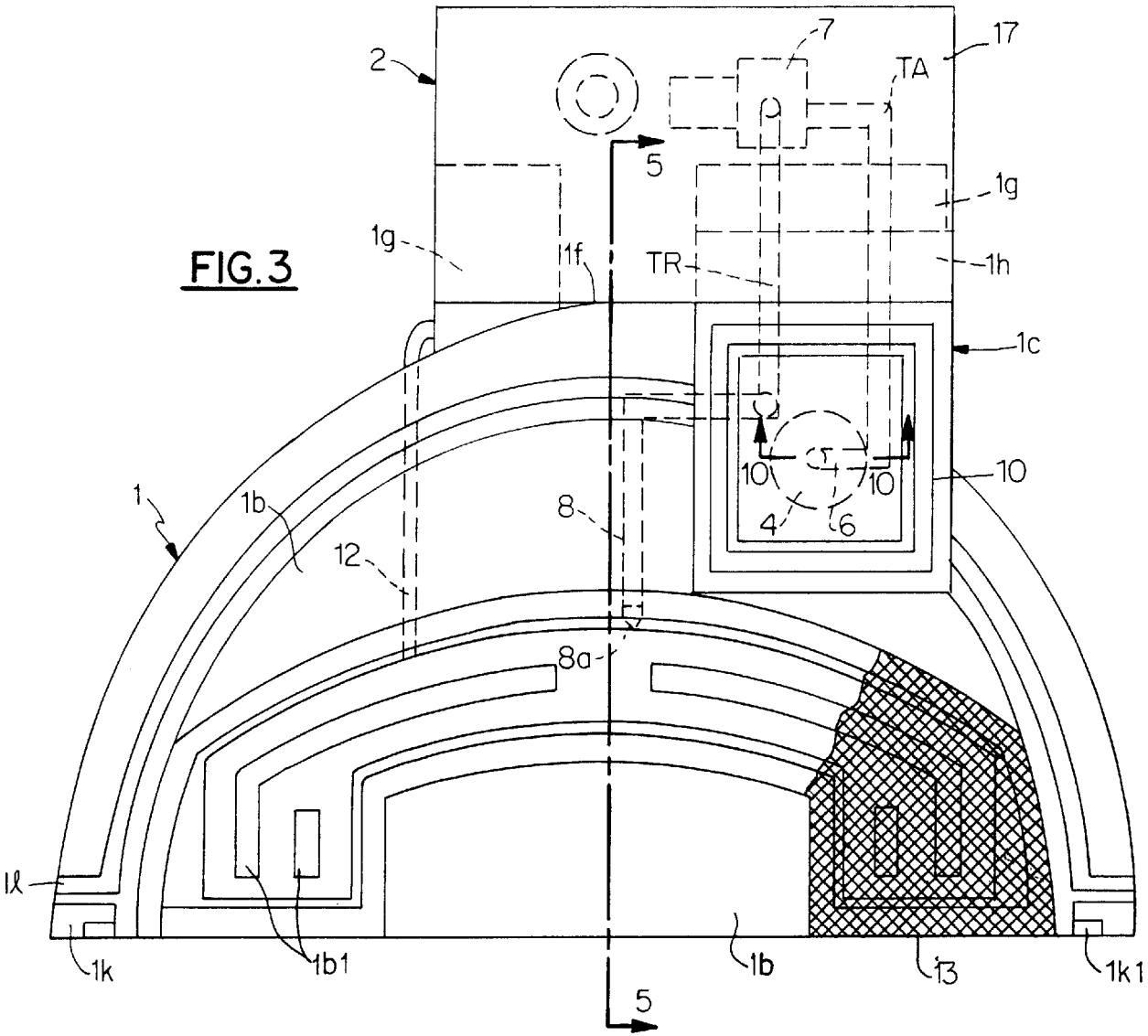
FIG. 3 is a view of the steps from above.
Figure 4:
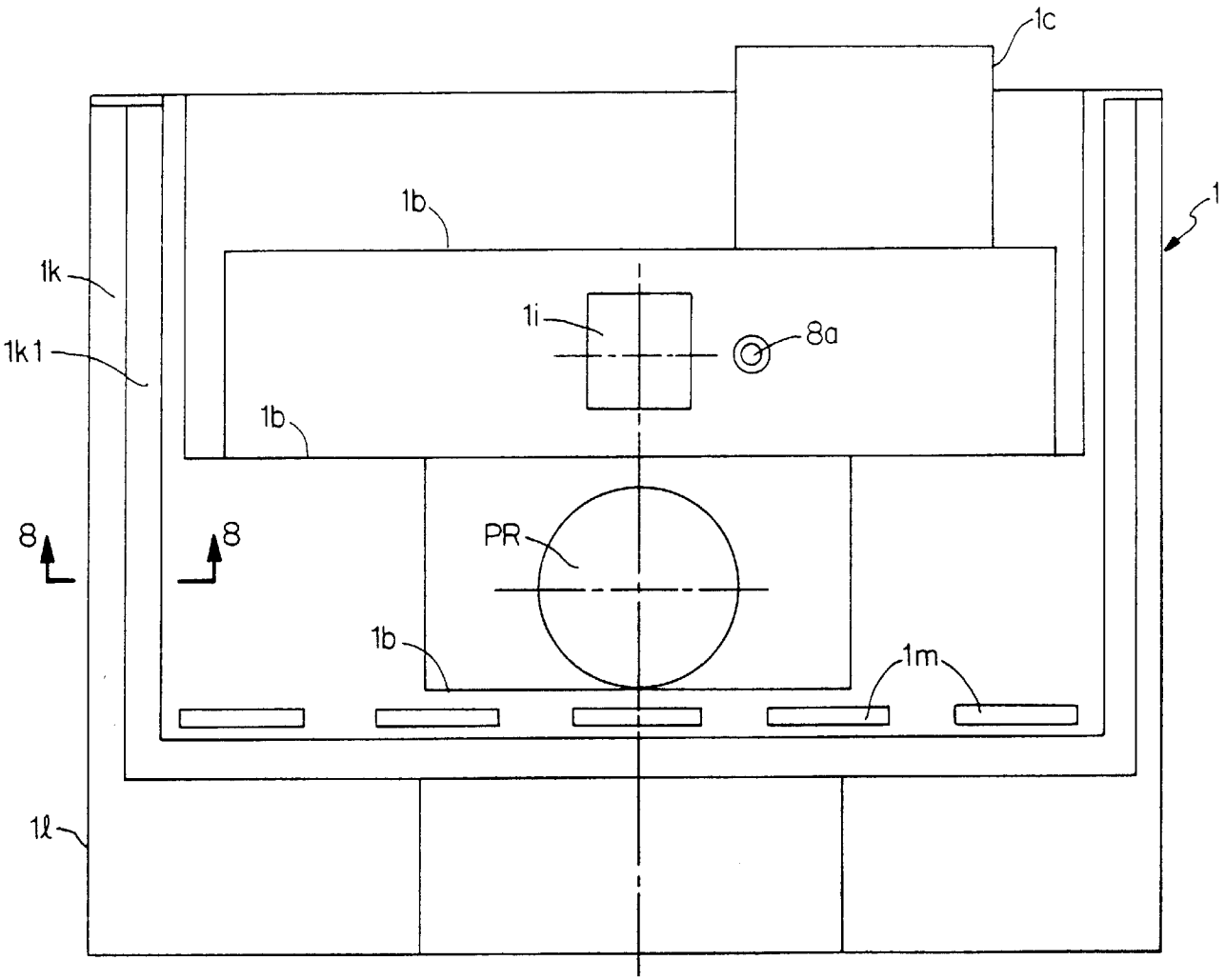
FIG. 4 is a view from the front corresponding to FIG. 3.

The face (1*f*) of the body (1) opposite to the face having the treads (1*b*), has arrangements for fitting and attaching a technical box (2) made by rotational moulding. This box (2) has a parallelepipedal overall shape. As best seen in FIG. 3, the arrangements on the face (1*f*) consist of braces (1*g*) formed at the time of rotational moulding of the body (1) protruding from the said face (1*f*). These braces (1*g*) constitute two support right-angle brackets on which the box (2) rests. Furthermore, the face (1*f*) of the body (1) has, at its upper end, a centering preform (1*h*) which is very much of rectangular shape, intended to interact with a complementary opening formed in the box (2). This centering preform (1*h*) is hollow and allows the intake pipe (TA) and delivery pipe (TR) to be mounted and passed, which pipes are mounted, as indicated below, in combination with the filtration system and the pumping system.

Figure 7:
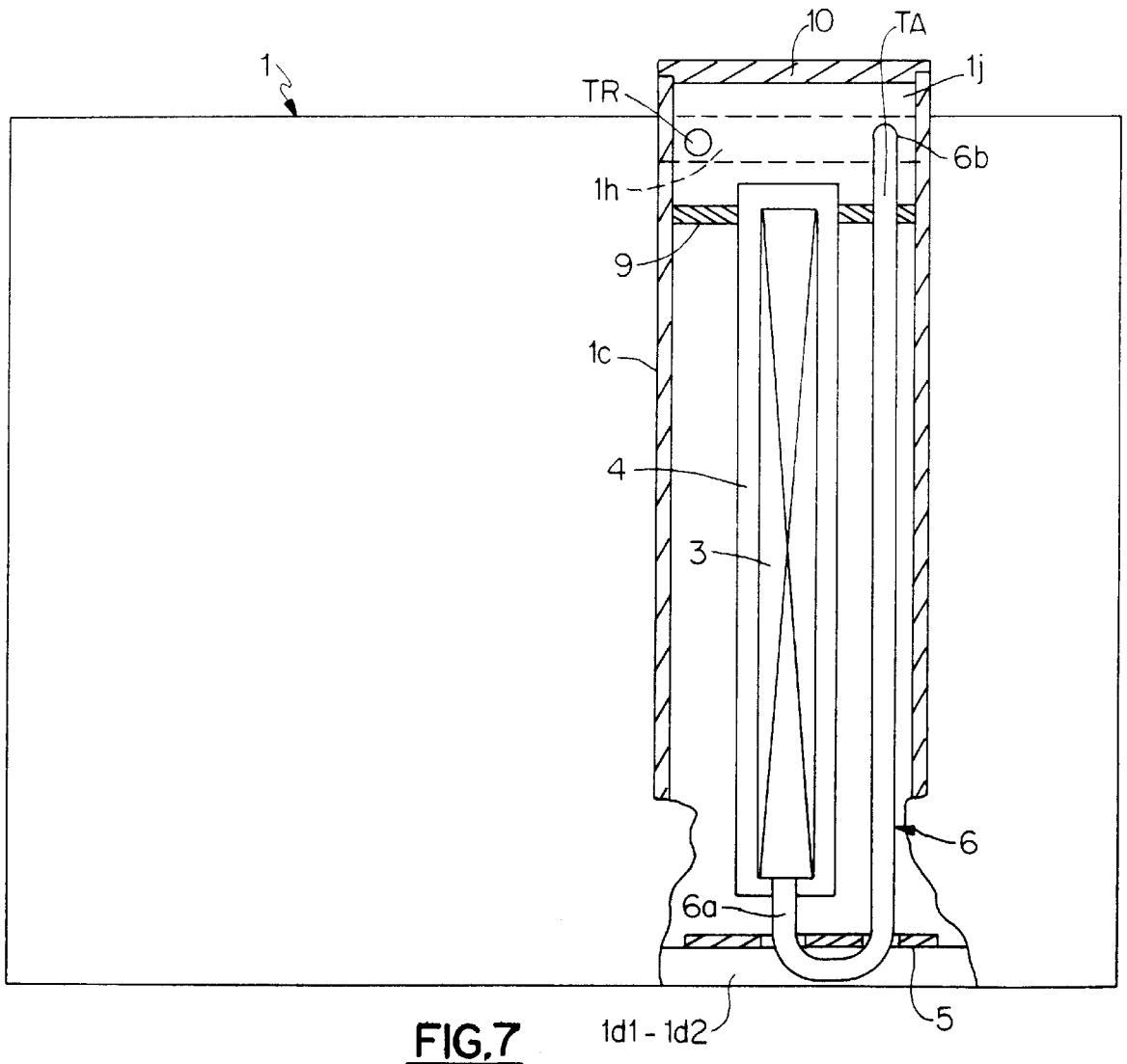
FIG. 7 is a view in longitudinal section of the steps assembly, showing the mounting of, the intake and delivery system combined with the filtration means.

With specific reference to FIG. 7, as far as the filtration system is concerned, the latter consists of at least one filter bag (3) housed in a support (4) of cylindrical overall shape. This filtration system is not described in detail and is advantageously of the type described in patent FR 89/13638, the proprietor of which is the applicant of this application. This filtration assembly (3) (4) is connected to a support plate (5) resting on two ribs (1*d*1) (1*d*2) formed in the bottom of the reservoir. This support plate (5) is connected to the intake pipe (TA) via a bent pipe (6) situated between the two ribs (1*d*1) (1*d*2).

Figure 10:
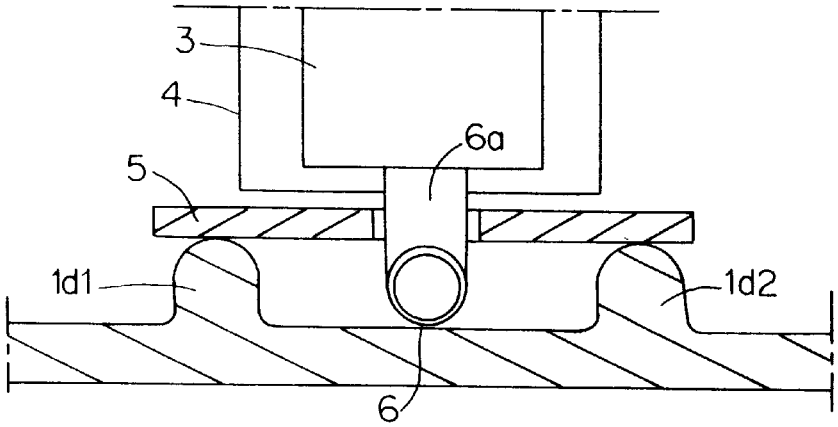
FIG. 10 is a view in section on the line 10.10 of FIG. 3.

As illustrated in FIG. 10, one of the ends (6*a*) of the pipe opens into the plate (5) to be connected to the base of the support (4) containing the filter bag (3), for example via a suction strainer.

The other end (6*b*) of the pipe (6) opens in the region of the centering preform (1*h*). The end (6*b*) of the pipe (6) protrudes from the centering preform (1*h*) to be connected in a watertight way by any known and appropriate means to the pumping system housed in the technical box.

More specifically, the intake pipe (TA) is connected to an intake connection exhibited by the pump (7) housed in the box (2). This pump is advantageously a two-speed pump.

Figure 5:
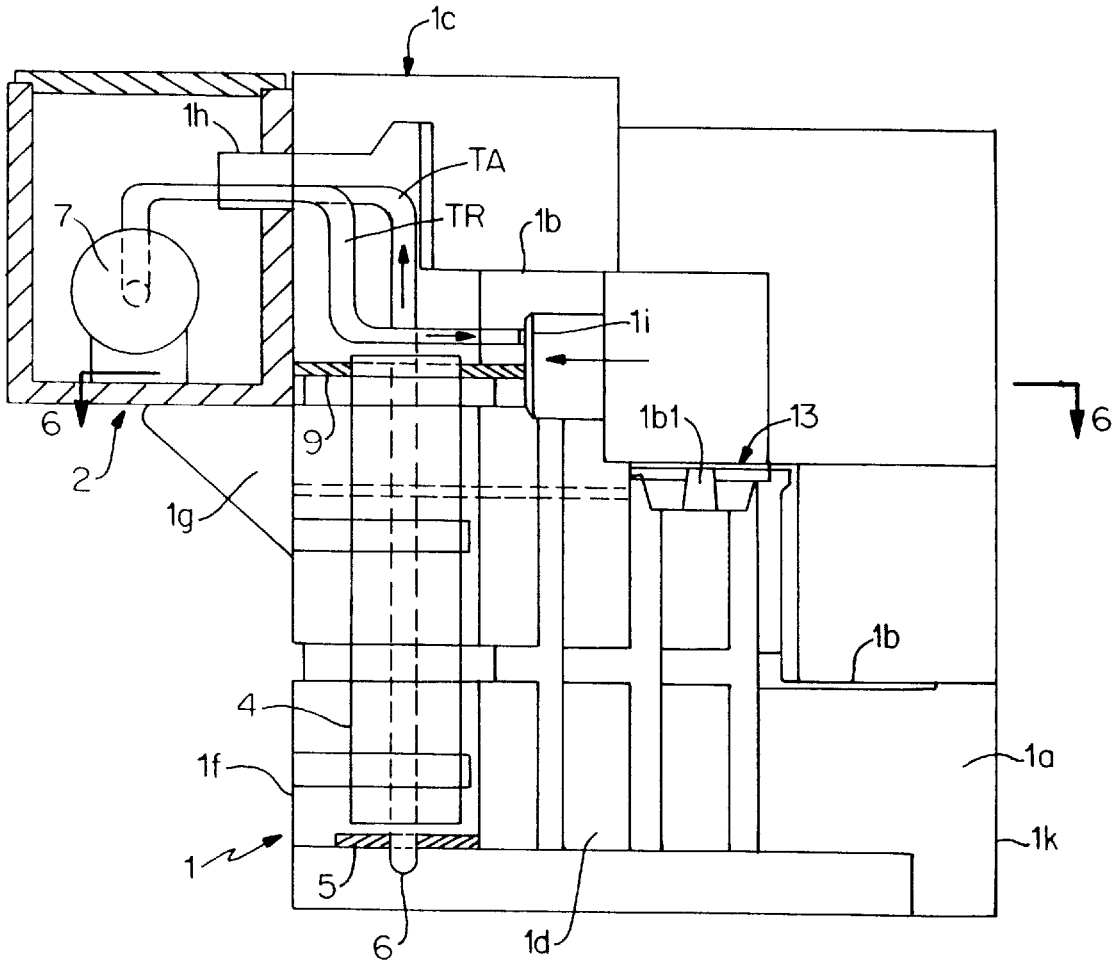
FIG. 5 is a view in section taken on line 5.5 of FIG. 3.
Figure 6:
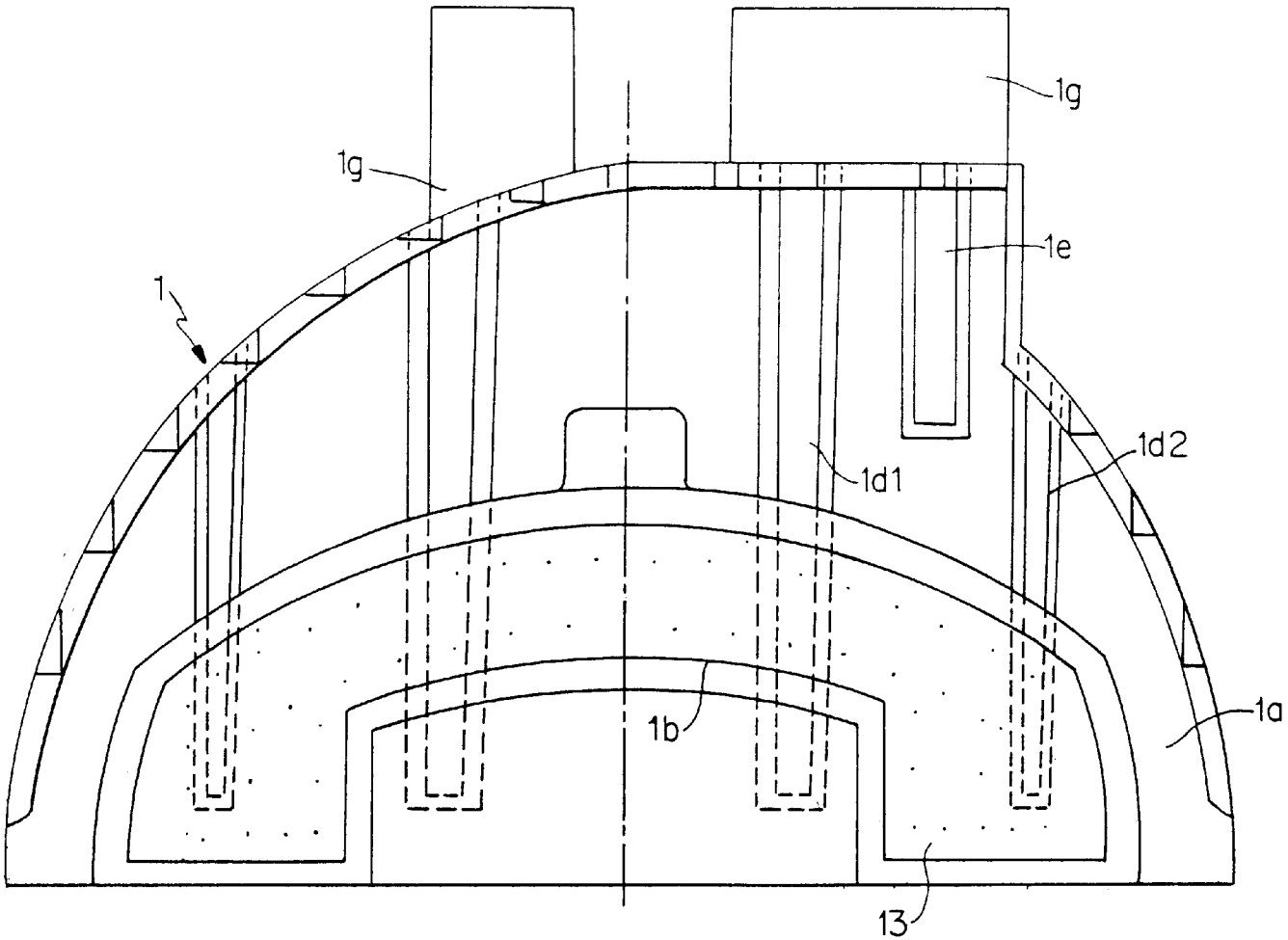
FIG. 6 is a view in section taken on line 6.6 of FIG. 5.

FIG. 3 and 5 show the delivery pipe (TR), connected to a corresponding connection of the pump (7), is coupled in a watertight way to a pipe (8) pre-installed inside the reservoir (1*a*) and opening, via a nozzle (8*a*) particularly in the region of the one of the risers of the steps.

Turning once again to FIG. 7 upper part of the support (4) containing the filter bag (3) is connected in a watertight way to a mounting plate (9), itself secured in a watertight way to the housing (1*c*) which is very much in the form of a chimney.

Figure 1:
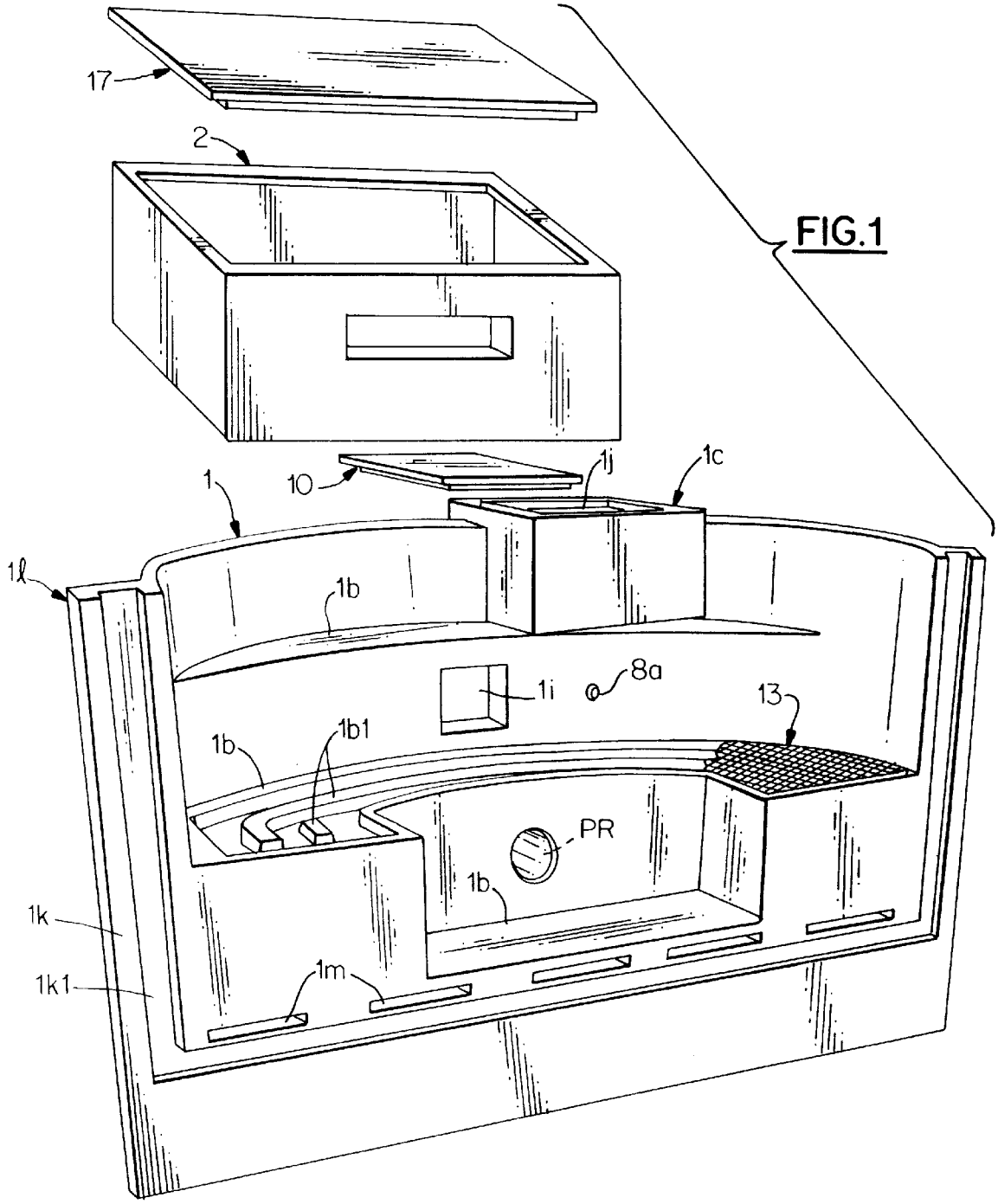
FIG. 1 is a perspective view of the filtering steps before the mounting of the technical box and considered from the front face of the steps.
Figure 2:
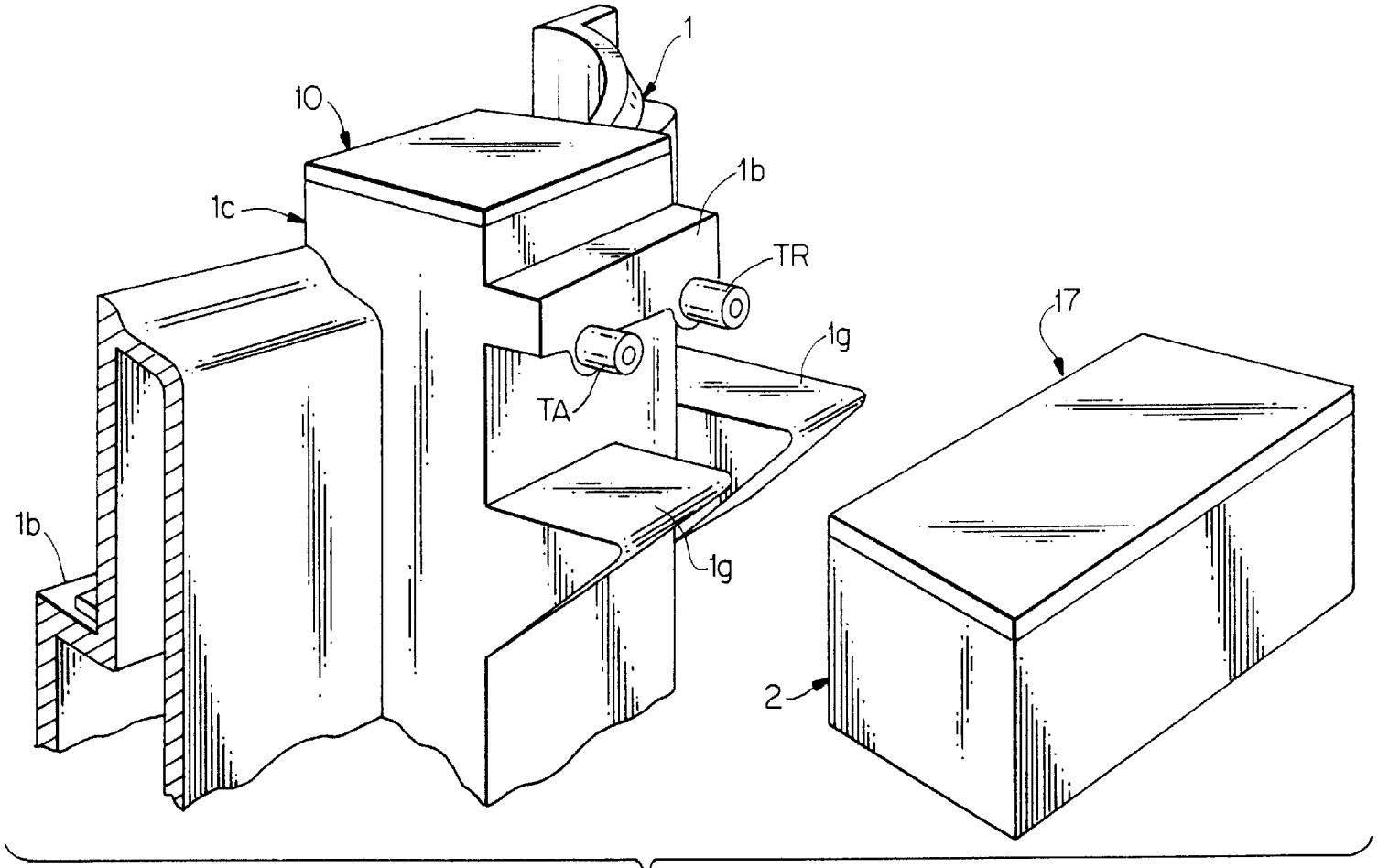
FIG. 2 is a view corresponding to FIG. 1, considered from the rear face of the steps.

As shown in FIG. 1, the entire filtration system comprising filter bag (3) and support (4) is therefore housed inside the reservoir (1*a*) while communicating with the water of the pool, which enters the said reservoir via an opening (1*i*) equipped, for example, with a skimmer. This opening (1*i*) is formed, for example, in the top riser of the set of steps.

What this means, in the known way, is that the water from the pool fills the reservoir (1*a*) via the opening (1*i*), passes through the filter (3) to be drawn in by the pump (7) via the pipes (6) and (TA) to be delivered by the said pump (7) via the pipes (TR) and (8).

Quite clearly, the reservoir (1*a*) and the box (2) may contain several filtration and pumping systems, in the conditions indicated hereinabove. The housing (1*c*), in the form of a chimney, communicates with an access hatch (1*j*) closed by a removable cover (10).

Because the body (1) of the steps and the technical box (2) are produced by rotational moulding, and particularly because the body of the steps (1) is produced in the form of a hollow body, the said box (2) is perfectly isolated from the body (1) in a watertight way.

As mentioned, the body (1) acts as a reservoir (1*a*) and is therefore constantly filled with water from the pool of the swimming pool. In order to avoid any problem of the proliferation of microbes or the like, it has been found that it is important that it should be possible for this water to be recirculated and therefore prevented from stagnating. To this end, the bottom of the reservoir has special arrangements.

Figure 11:
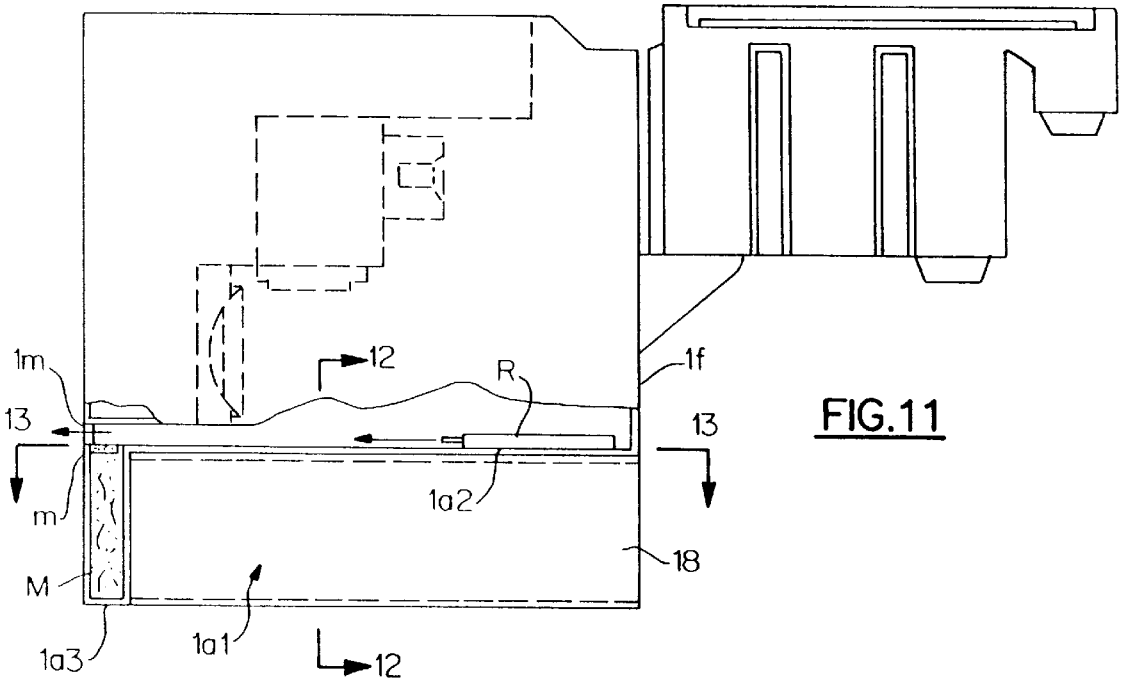
FIG. 11 is a partial longitudinal sectional 10 view of the block, particularly in the region of its bottom.
Figure 13:
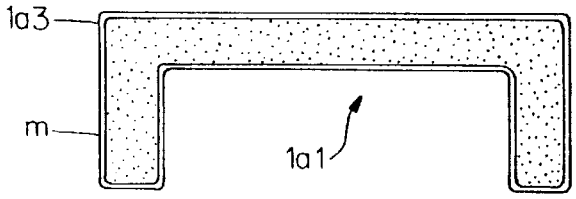
FIG. 13 is a view in section on the line 13.13 of FIG. 11.
Figure 12:
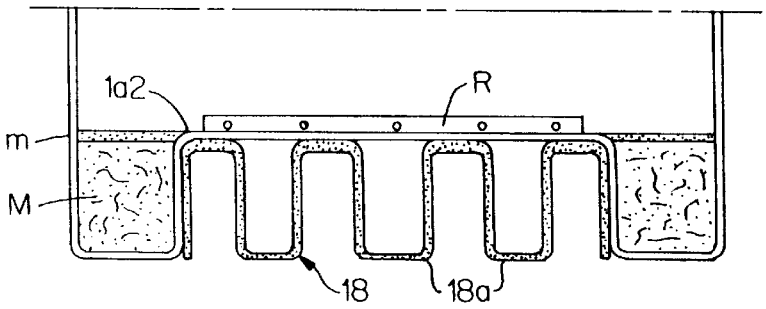
FIG. 12 is a view in cross-section on the line 12.12 of FIG. 11.

As FIGS. 11, 12 and 13 show, the bottom of the reservoir has a hollow indentation (1*a*1) formed from the rear face (1*f*) of the body (1) so as to delimit a bottom (1*a*2) which is raised with respect to a base (1*a*3) for resting on the ground, with an overall U shape and hollow internal cross-section. The raised bottom (1*a*2) is perfectly smooth and lies in a horizontal plane level with the first tread of the steps counting from the bottom and so that it is in line with open slots (1*m*) formed in the thickness of the corresponding riser. The internal cross-section of the resting base (1*a*3) is filled with a lightweight material such as a foam (M), itself covered, for example, with a perfectly smooth screened (m) so as to make it continuous with the raised bottom (1*a*2).

Above the raised bottom there is a boom (R) connected to the delivery pipework. This boom has a number of water jets in order to repel dirtiness or the like which may appear on the raised bottom so that it can be discharged through the slots (1*m*) in the pool of the swimming pool and be recirculated, passing it through the filtration system.

These measures therefore make it possible to avoid any stagnation of bacteria or the like in the bottom of the reservoir.

As mentioned, the raised bottom (1*a*2) results from a hollow indentation (1*a*1). This being the case, in order not to reduce the rigidity of the reservoir, the indentation contains a technical support box (18) formed of a number of stiffening ribs (18*a*). This technical support box (18) is attached to the body (1) by any known and appropriate means.

According to another feature, one of the treads (1*b*) has, in its horizontal face, directly from rotational molding, ribs (1*b*1) shown in FIG. 5 delimiting hollow spaces, to communicate with an air intake connected by a pipe (12) to a member housed in the technical box (2). The tread (1*b*), equipped with ribs (1*b*1) receives a microperforated plate (13).

It is also envisaged that arrangements be formed in at least one of the risers, for positioning at least-one lamp (PR).

Figure 8:
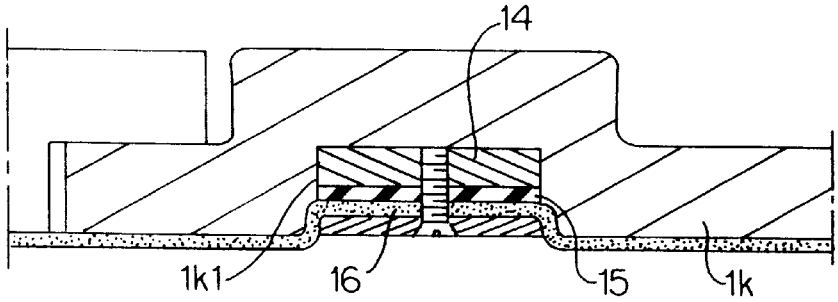
FIG. 8 is, to a larger scale, a view in section on the line 8.8 of FIG. 3, showing the arrangements for attaching the liner.

As shown in FIG. 8, the front face of the body (1) in the region of the treads (1*b*) has a U-shaped clamp (1*k*). Formed in the thickness of this clamp (1*k*) is a groove (1*k*1) in which there is attached, particularly by bonding, a screwing support (14) covered with a gasket (15). These measures allow the liner (L), cut to a U shape, to be attached using screws which can be screwed into the support (14). A strip (16) covers the entire screwing support.

Figure 8A:
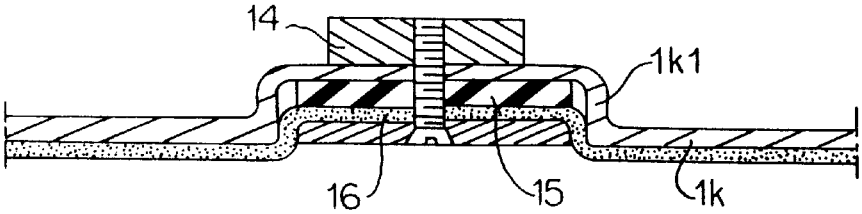
FIG. 8A is a view in section showing a preferred embodiment of the arrangements for attaching the liner.

Advantageously, as FIG. 8A shows, the screwing support (14) is located not inside the groove but outside the groove, that is to say inside the reservoir (1*a*), so as to get around the problem of water tightness in the corners where the various elements of the screwing support meet.

Figure 9:
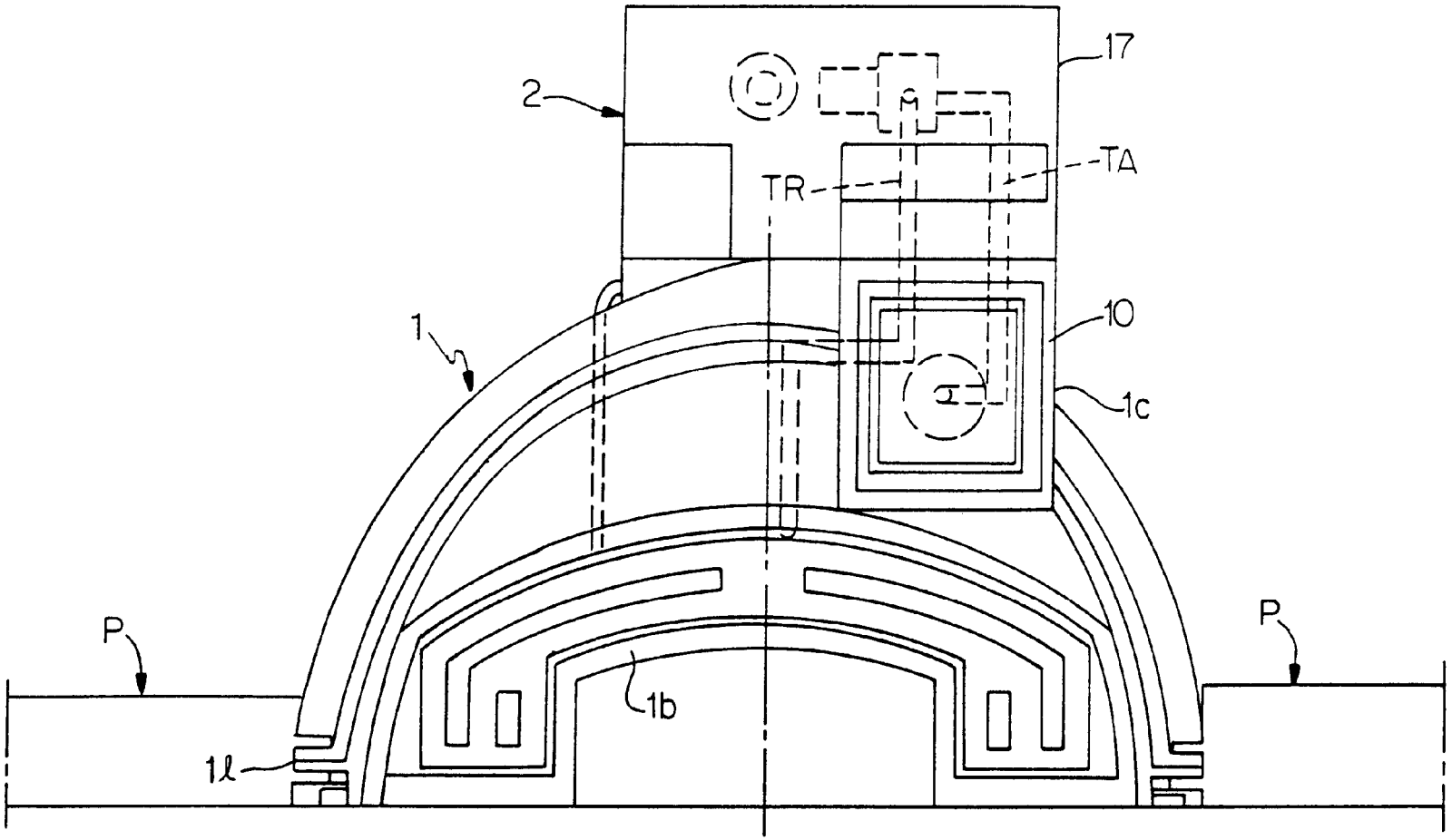
FIG. 9 is a view showing the assembling of the filtering steps in combination with adjacent panels of the pool of the swimming pool.

Finally, as illustrated in FIG. 9, the front face of the body (1) has lateral flanges (11), in the thickness of which metal inserts are embedded for attaching the steps assembly in a watertight way to the other paneld (P) which make up the pool part of the swimming pool. It is also envisaged that part of the external periphery of the body (1) be equipped with metal inserts for attaching vertical chutes, the cross-section of which is shaped to contain concrete.

Quite clearly, the technical box (2) containing the pumping system is closed in a watertight manner by a removable cover (17).

The advantages are clearly apparent from the description; in particular, the following are emphasized and recalled:

manufacture by rotational moulding making it possible to obtain steps in the form of a hollow and perfectly watertight volumetric body, the reduction in the cost of manufacture, the possibility of incorporating other functions, the possibility of assembling the filtering steps assembly in a watertight way in continuity with the other panels which make up the pool part of the swimming pool.

What is claimed is:

1. Apparatus for use in association with a swimming pool said apparatus including a body having a front face facing a pool and an opposing rear face, said body defining a closed reservoir produced by rotational moulding, said reservoir having means for producing a flow in communication with water in said pool, said body further containing filtering means in communication with said reservoir, said front face of said body contains steps for entering and leaving said pool, said rear face of said body having mounting means for attaching a box produced by rotational molding to said body, said box containing pump means for communicating with said filtering means, and attaching means for connecting said body to a wall of said pool to provide a watertight joint therebetween.

2. The apparatus of claim 1 wherein said body contains integral ribs located in a bottom part of the reservoir for supporting a plate thereon upon which said filtering means is seated.

3. The apparatus of claim 2 further including a U-shaped pipe having a bend, said pipe bend being located between two of said ribs, one end of said pipe being connected to said filtering means and the other end to said pump means.

4. The apparatus of claim 3 wherein said pump means is connected to an inlet passing through one of said steps.

5. The apparatus of claim 2 that further includes a support housing for enclosing said filtering means, a plate mounted in a watertight manner in said housing which is cojoined in a watertight manner to a chimney in the top of said reservoir, said chimney being closed by a top cover.

6. The apparatus of claim 1 wherein said reservoir has a bottom having a hollow indentation joined to the rear face of said body said indentation delineating said bottom which is raised with respect to a base upon which the body rests, said raised bottom being in alignment with open slots formed in one of said steps, said bottom being U-shaped and filled with a lightweight material.

7. The apparatus of claim 6 wherein the hollow indentation delineating the raised bottom is closed by a technical support housing formed by a number of stiffening ribs.

8. The apparatus of claim 6 wherein said raised bottom has a boom attached thereto that is connected to an inlet pipe to said pump, said boom being arranged to direct water over the said bottom and discharge said water back to the pool through said slots.

9. The apparatus of claim 1 that further includes a fitting for attaching said box to said body that contains braces formed during rotational molding of said body upon which said box rests and a centering preform interacting with an opening in said box, said preform containing intake and delivery pipes that are connected to said pump housed in said box.

10. The apparatus of claim 1 wherein one of said steps contains spaced apart raised ribs, the spaces between said ribs communicating with air intake means connected to a component in said technical support housing, said one of said steps further containing a microperforated plate therein.

11. The apparatus of claim 1 wherein said attaching means includes lateral flanges containing metal inserts for receiving fastening means.

12. The apparatus of claim 1 wherein the external periphery of the body contains metal inserts for attaching vertical chutes to said body, said chutes being arranged to accept concrete therein.

13. The apparatus of claim 1 wherein the front face of said body contains a U-shaped clamp containing a threaded support covered by a gasket to which a pool liner is attached by fasteners.

14. The apparatus of claim 2 that further contains a lamp means mounted in one of said steps.

* * * * *